United States Patent [19]

Dodge

[11] Patent Number: 4,460,061

[45] Date of Patent: Jul. 17, 1984

[54] APPARATUS FOR INCREASING DIRECTIVITY OF A SOUND SOURCE

[75] Inventor: Robert J. Dodge, Houston, Tex.

[73] Assignee: Pennwalt Corporation, Philadelphia, Pa.

[21] Appl. No.: 413,019

[22] Filed: Aug. 30, 1982

[51] Int. Cl.[3] ..... G10K 11/00

[52] U.S. Cl. ..... 181/175

[58] Field of Search ..... 181/19, 147, 143, 150, 181/153, 175, 196–199; 116/137 R, 147; 179/1 MF, 1 AM; 340/815, 33; 310/335

[56] References Cited

U.S. PATENT DOCUMENTS

| | | | |
|---|---|---|---|
| 2,457,527 | 12/1948 | Bruce | 181/175 |
| 2,480,199 | 8/1949 | Rosenberg et al. | 181/175 X |
| 3,007,133 | 10/1961 | Padberg, Jr. | 181/175 X |
| 3,483,945 | 12/1969 | Michael | 181/143 |
| 4,314,098 | 2/1982 | Maerfeld | 181/175 X |
| 4,322,578 | 3/1982 | Selmin | 181/175 X |

*Primary Examiner*—L. T. Hix
*Assistant Examiner*—Brian W. Brown

[57] ABSTRACT

Directivity of a sound source is significantly increased when the source is positioned within the geometrical center of a ring having a diameter and height of 1 wavelength and ½ wavelength respectively. Sound energy radiates to the ring and is re-radiated or diffracted at the top and bottom thereof. The re-radiated or diffracted sound energy thus appears to be generated by two simple sources, in phase and vertically arranged, one source being at the top of the ring and the other at its bottom, resulting in increased intensity along the horizontal plane bisecting the sources. The two phased sources at the top and bottom of the ring may be considered to be located along any imaginary vertical plane through the single source. Sound intensity in a desired plane or direction is thus increased without a concomitant increase in power, number of sources or components.

7 Claims, 8 Drawing Figures

VERTICAL DIRECTIVITY OF AN OMNIDIRECTIONAL SOUND SOURCE WITH AND WITHOUT DIFFRACTION RING

APPARATUS FOR INCREASING DIRECTIVITY OF A SOUND SOURCE

STATEMENT OF THE INVENTION

This invention relates to apparatus for increasing the directivity of a sound source.

BACKGROUND AND SUMMARY OF THE INVENTION

It is often desirable to increase the intensity of sound in a particular direction without increasing the total radiated sound, or power input to the sound source. Signal devices such as fog warning signals, for example, are more efficient when the sound is directed in a horizontal plane toward the mariner. A narrow horizontal pattern of sound radiation provides a more efficient use of energy, i.e., less energy is required to achieve a certain sound level in a desired plane or direction.

Some typical techniques for increasing directivity of a sound source employ baffles or multiple source arrays. Baffles are capable of increasing the intensity of sound in a direction normal to the plane of the baffle but are not useful when the sound must be radiated equally in all horizontal directions.

Multiple source arrays may be used for increasing the intensity of sound in a horizontal direction. It is known that a vertical arrangement of multiple phased sources will generally add along the horizontal bisecting plane. The signal path lengths are equal along the horizontal plane and if the signals are generated in phase and travel the same distances at the same speed, the signals will reach an observer or mariner located in the horizontal plane in phase, i.e., two phased sources, for example, will add together to produce a summed signal of twice the pressure amplitude, or 4 times the intensity of one of the sources.

The present invention provides a simple and inexpensive device or apparatus which produces a result similar to that achieved with multiple phased sources, and more particularly, to two phased sources vertically, arranged, but requiring only a single source.

Briefly, a sound source of a selected wavelength is geometrically centered within a ring positioned to have its open ends in substantial vertical alignment. The diameter and height of the ring are approximately 1 wavelength and ½ wavelength respectively. Wavelength is hereinafter referred to as "λ".

The single sound source radiates sound energy to the ring where the sound energy is re-radiated or diffracted to increase the sound intensity in a horizontal plane, not unlike the sound energy generated by two phased sources, vertically arranged, and spaced about ½ λ apart. A horizontal signal of approximately 2× the intensity of the single source is thus produced while the intensity in the vertical direction in a vertical plane through the sources is reduced substantially.

DETAILED DESCRIPTION OF THE INVENTION

The most elementary radiator of sound is a simple source or point source. Simple sources or point sources radiate sound uniformly in all directions, i.e., the sound pressure at a point a specified distance from the source is theoretically equal to any other point in any direction an equal distance from the source.

Figure 1:
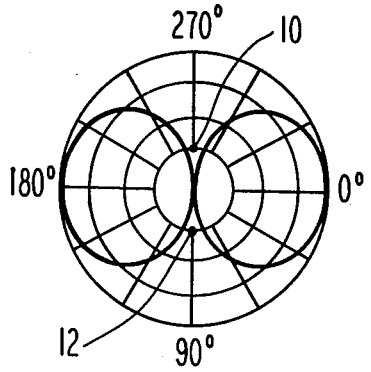
FIG. 1 illustrates the vertical directivity pattern obtained from two simple sources spaced vertically by approximately ½ λ and operated in phase.

Two simple sound sources in phase, spaced vertically ½ λ apart however produce a directivity pattern unlike a spherical pattern obtained with a point sound source. The two simple sound sources will radiate sound in some directions better than others. Thus, in FIG. 1, the signal intensity from sources 10 and 12 is increased in the horizontal direction by a factor of 2 times that of a single source radiating the same power. The sound intensity is theoretically cancelled in the vertical direction, i.e., on the 90°–270° line joining the sources.

Figure 2:
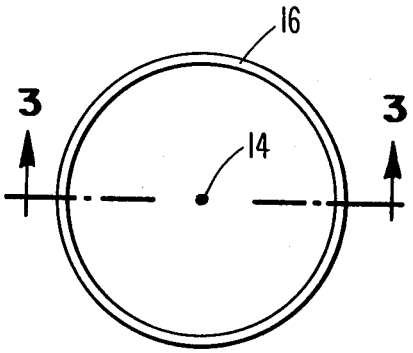
FIG. 2 is a plan view of a single sound source centered within a diffraction ring of the present invention.
Figure 3:
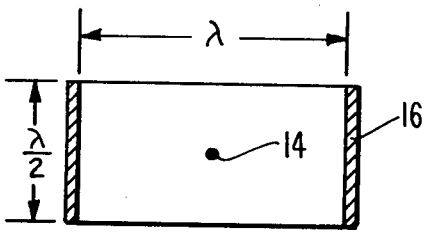
FIG. 3 is a sectional view of FIG. 2 taken along line 3—3 thereof.

In FIGS. 2 and 3, a single sound source 14 is geometrically centered within a diffraction ring 16 made of a suitable hard material such as steel, aluminum, or fiberglass, for example. Diffraction ring 16 has a diameter of approximately 1 λ and a height of approximately ½ λ.

Figure 4:
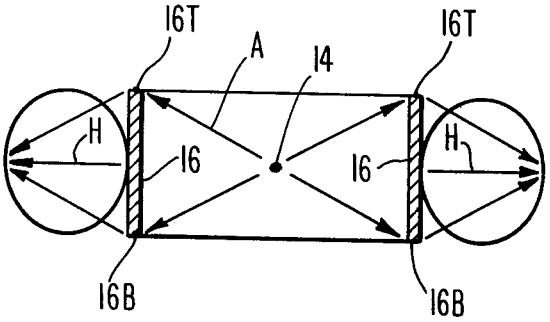
FIG. 4 diagrammatically illustrates the vertical directivity pattern resulting from energy generated by the geometrically centered single sound source within the diffraction ring of FIG. 3.

In FIG. 4, sound energy generated by single sound source 14 radiates to diffraction ring 16 as indicated by arrows A therewithin. Ring 16 re-radiates or diffracts the sound energy from points at its top 16T and bottom 16B. Points 16T and 16B are vertically aligned and may be said to lie on any vertical plane through source 14. Thus, points 16T and 16B function as two simple point sources, vertically aligned and spaced approximately ½ λ apart. Such point sources 16T and 16B throughout the ring radiate sound energy therefrom to thereby increase the sound intensity in the horizontal direction as indicated by the horizontal line H (FIG. 4) in a manner similar to the increase in sound intensity in the horizontal direction produced by sources 10 and 12 of FIG. 1.

Figure 5:
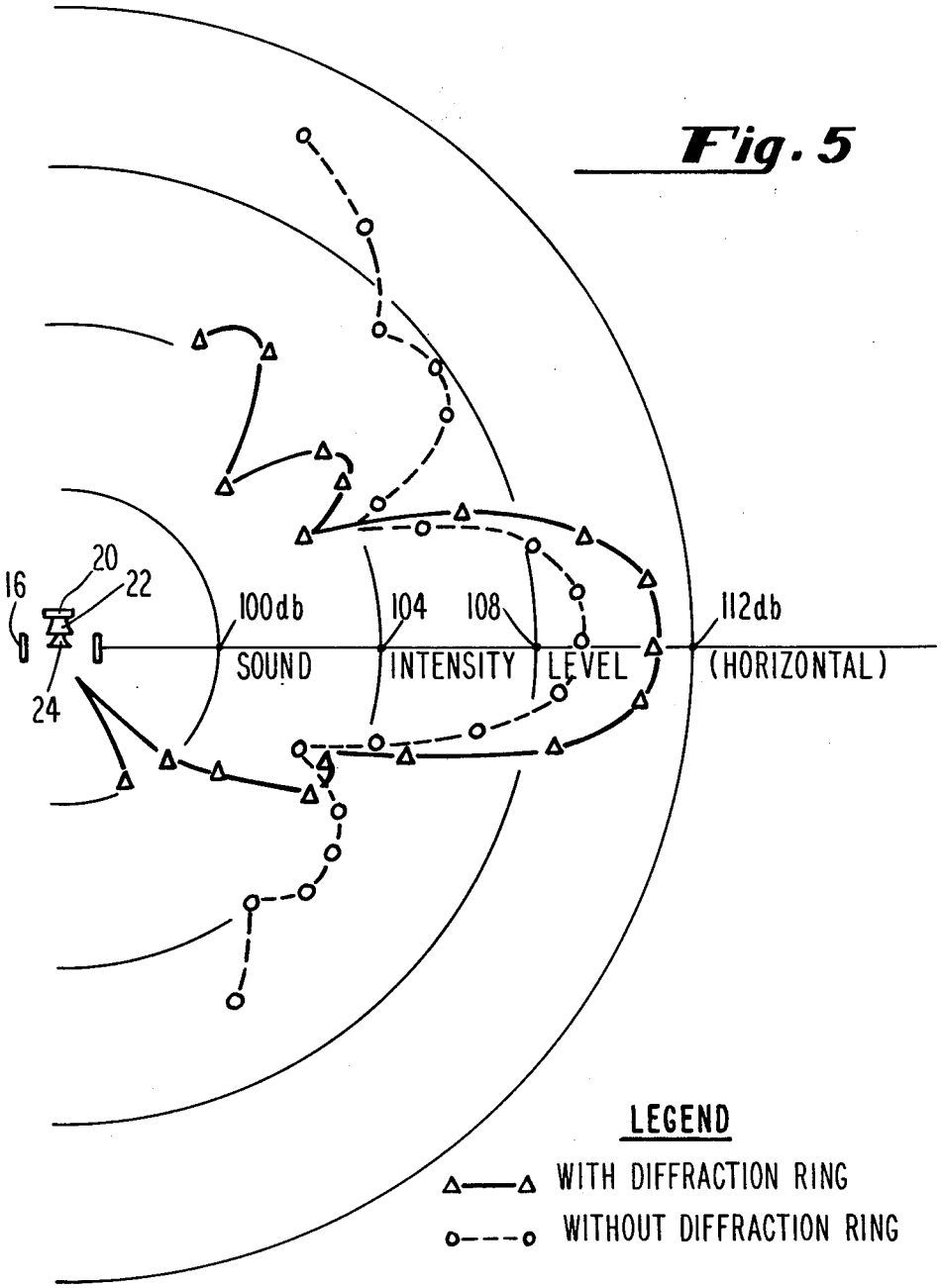
FIG. 5 is a graphical representation of sound intensity level measured in a vertical plane through an omnidirectional sound source with and without the use of the diffraction ring of the present invention.

In FIG. 5, a conventional public address driver 20 and horn 22 are employed as an omnidirectional sound source. The term "omnidirectional" as used herein indicates the generation of sound substantially equally in all horizontal directions. A diffuser plate 24 is mounted below horn 22 in vertical alignment with the driver and horn. Diffuser plate 24 provides horizontal directivity to sound energy emanating from the horn.

The graph represents the directivity pattern of a vertical plane through the sound source. Data for the graph were obtained in an anechoic chamber. 10 watts of power was constantly applied to driver 20. The frequency of the sound generated ranged between 680 to 700 Hz and the distance between the sound source and a microphone measuring the intensity level of the sound was maintained at 2 meters.

It can be seen from the graph of FIG. 5 that the horizontal sound intensity has been increased about 2 decibels (db), i.e., from about 109 db to about 111 db, when the diffraction ring 16 of the present invention is employed. A 2 db increase in intensity represents approximately a 1.6 increase in horizontal intensity, or an intensity increase of almost 60%.

Figure 6:
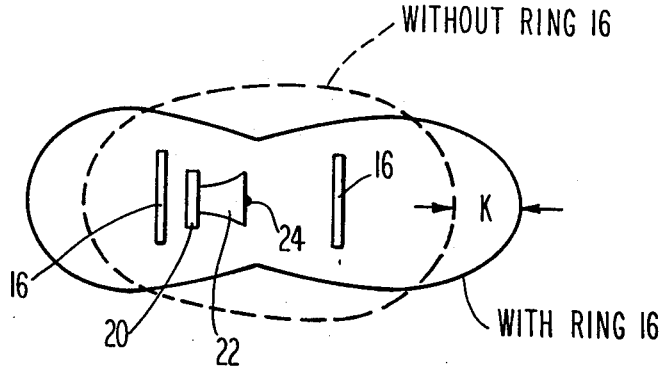
FIG. 6 diagrammatically illustrates horizontal intensity of a directional sound source used with and without the diffraction ring of the invention.

In FIG. 6, driver 20 and horn 22 have source 24 positioned within the geometric center of diffraction ring 16 resulting in an increase in the horizontal intensity level by an increment of K. The re-radiated sound energy from ring 16, of course, is not omnidirectional.

Figure 7:
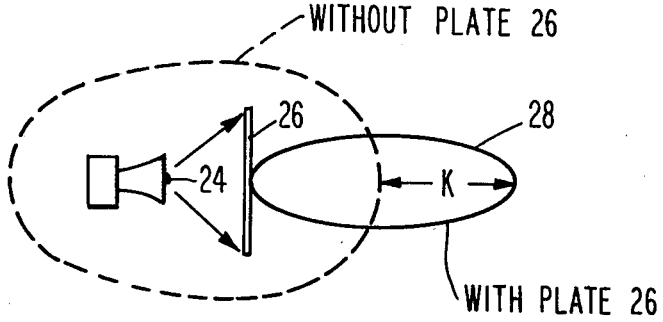
FIG. 7 diagrammatically illustrates an embodiment of the invention for achieving a pencil beam of sound from a directional sound source.

In FIG. 7, a circular flat plate 26 is centered on the source 24 as shown. Plate 26 is provided with a diameter of approximately $\frac{1}{2}\lambda$ and is spaced from source 24 by a like measurement. Plate 26 produces a ring of phased sources at its periphery resulting in the formation of a pencil beam 28 of sound. The horizontal intensity level is increased by a an increment of K over the intensity level achieved without the use of plate 26.

Figure 8:
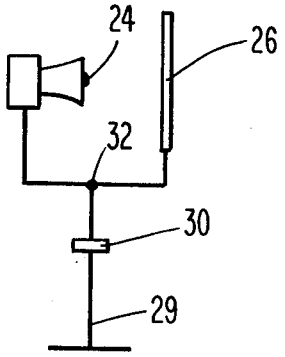
FIG. 8 diagrammatically illustrates structure permitting the pencil beam of sound of FIG. 7 to be aimed.

Referring now to FIG. 8, source 24 and circular flat plate 26 are spaced apart approximately $\frac{1}{2}\lambda$ and are maintained in that relationship by suitable support structure 29 rigidly interconnected therebetween. Rotating the source 24 and plate 26 as a unit for purposes of aiming the resultant concentrated pencil beam of sound energy may be accomplished, typically, by a reversible stepping motor 30. Support structure 30 may be adapted for pivoting about pivot point 32 by well known means.

I claim:

1. Apparatus for increasing directivity of a sound source comprising a sound source of a particular wavelength, a single diffraction ring geometrically centered about said sound source, said ring having a diameter and height of approximately said particular wavelength and one-half said particular wavelength respectively, said ring radiating sound energy from said sound source.

2. Apparatus for increasing horizontal directivity of a sound source comprising a sound source of a selected wavelength, a single diffraction ring geometrically centered on said sound source, said ring having an imaginary axis through open ends thereof perpendicularly disposed to a horizontal plane, said ring having a diameter and height approximating said selected wavelength and one-half said selected wavelength respectively, said ring radiating sound energy from said sound source.

3. Apparatus of claim 2 wherein said sound source is a simple sound source.

4. Apparatus of claim 2 wherein said sound source is a directional sound source.

5. Apparatus of claims 3 or 4 wherein said ring is made from a hard material.

6. Apparatus for increasing directivity of a directional sound source comprising a directional sound source of a certain wavelength, a circular flat plate focused forwardly said directional sound source for receiving sound energy generated therefrom, said plate having a diameter of, and being spaced from said directional sound source by, approximately one-half said certain wavelength, said sound source and circular flat plate being devoid of any reflector means therebetween, said circular flat plate radiating sound energy from its periphery for forming a pencil beam of sound, said circular flat plate radiating said sound energy from said directional sound source.

7. Apparatus of claim 6 further characterized by support means rigidly interconnecting said sound source and plate in fixed spaced focused relationship, and means for rotating said support means to align said sound source and plate with a target.

* * * * *